US006702162B1

(12) United States Patent
Hassid

(10) Patent No.: US 6,702,162 B1
(45) Date of Patent: Mar. 9, 2004

(54) BUTTON ATTACHING DEVICE

(76) Inventor: Gilbert F. Hassid, 1000 West Ave. #7, Miami Beach, FL (US) 33139

( * ) Notice: Subject to any disclaimer, the term of this patent is extended or adjusted under 35 U.S.C. 154(b) by 0 days.

(21) Appl. No.: 10/238,328

(22) Filed: Sep. 11, 2002

(51) Int. Cl.[7] ..... A41H 43/00
(52) U.S. Cl. ..... 223/1; 24/114.7
(58) Field of Search ..... 223/1; 112/104; 163/1; 24/93, DIG. 32, 380, 379.1, 114.7

(56) References Cited

U.S. PATENT DOCUMENTS 2,104,885 A * 1/1938 Robbins ..... 24/114.7
5,383,260 A * 1/1995 Deschenes et al. ..... 24/711
5,518,162 A * 5/1996 Deschenes et al. ..... 227/71
5,671,507 A * 9/1997 Deschenes et al. ..... 24/114.7
5,954,242 A * 9/1999 Deschenes et al. ..... 223/1

* cited by examiner

*Primary Examiner*—John J. Calvert
*Assistant Examiner*—James G Smith

(57) ABSTRACT

A button attaching device includes a pair of elongate members each having a pointed first end and a hole adjacent to a second end. Each of the elongate members has a slit therein extending from an outer surface to a corresponding one of the holes. A thread extends between the elongate members and extends through the holes. The thread has a pair of knots therein adjacent to opposite ends of the thread such that the elongate members are secured together by the thread. Each of the elongate members may be extended through one of a pair of openings in a button and through the cloth such that the button is secured to the cloth. The thread is releasable through the slits such that the thread is released from the elongate members.

6 Claims, 4 Drawing Sheets

BUTTON ATTACHING DEVICE

BACKGROUND OF THE INVENTION

1. Field of the Invention

The present invention relates to button fastening apparatuses and more particularly pertains to a new button fastening apparatuses for allowing a user to more efficiently secure a button to an article of cloth.

2. Description of the Prior Art

The use of button fastening apparatuses is known in the prior art. U.S. Pat. No. 4,281,782 describes a button sewing device for use in attaching a button to a piece of material. Another type of button fastening apparatus is U.S. Pat. No. 5,678,747 describes a double needle button attacher for attaching buttons. U.S. Pat. No. 4,316,562 describes a button attaching tool having thread receiving eyes. The tool is extendable through material and through holes in a button to secure the button to the material. U.S. Pat. No. 4,361,101 describes a pocket button attaching device. Other related patents include U.S. Pat. No. Des. 362,606, U.S. Pat. No. 5,755,371, and U.S. Pat. No. 5,915,614.

While these devices fulfill their respective, particular objectives and requirements, the need remains for a device that is more efficient and quicker to use than prior inventions.

SUMMARY OF THE INVENTION

The present invention meets the needs presented above by utilizing a flexible needle that can easily bend and has perforations that easily tear allowing the user to quickly separate the needle from the thread.

The object of the present invention is to provide a new button fastening apparatus includes thread having needles attached thereto.

Another object of the present invention is to provide a new button fastening apparatus that could be easily carried in a purse or wallet for emergencies.

To this end, the present invention generally comprises a pair of elongate members each has a first end and a second end. Each of the first ends is pointed Each of the elongate members has a hole extending therethrough and positioned adjacent to the second ends. The elongate members each have a slit therein extending from an outer surface to a corresponding one of the holes. A thread extends between the elongate members and extends through the holes. The thread has a pair of knots therein disposed generally adjacent to opposite ends of the thread such that the elongate members are secured together by the thread. Each of the elongate members may be extended through one of a pair of openings in a button and through a cloth such that the button is secured to the cloth. The thread is releasable through the slits such that the thread is released from the elongate members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
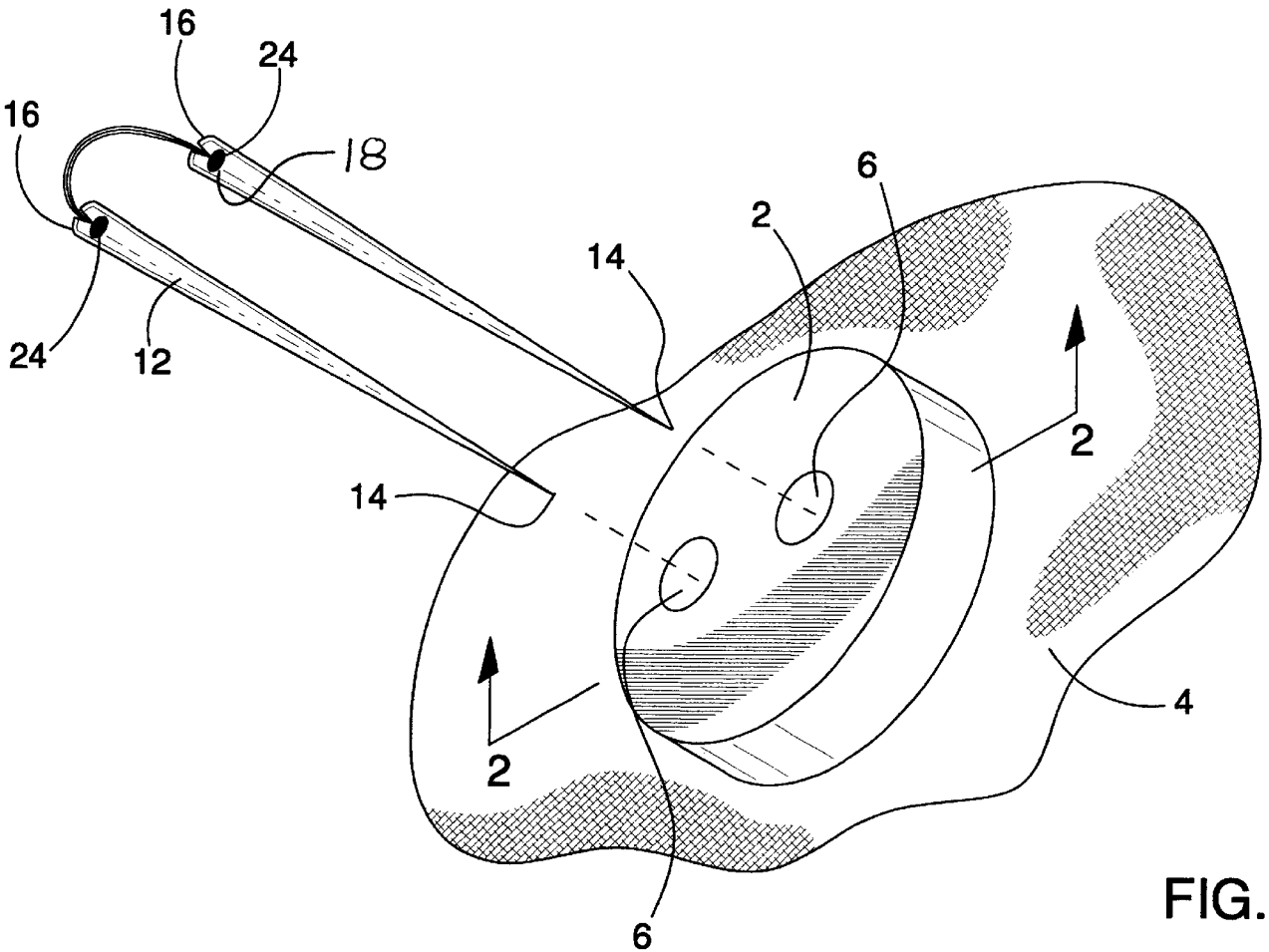
FIG. 1 is a perspective view of a button attaching device according to the present invention.
Figure 2:
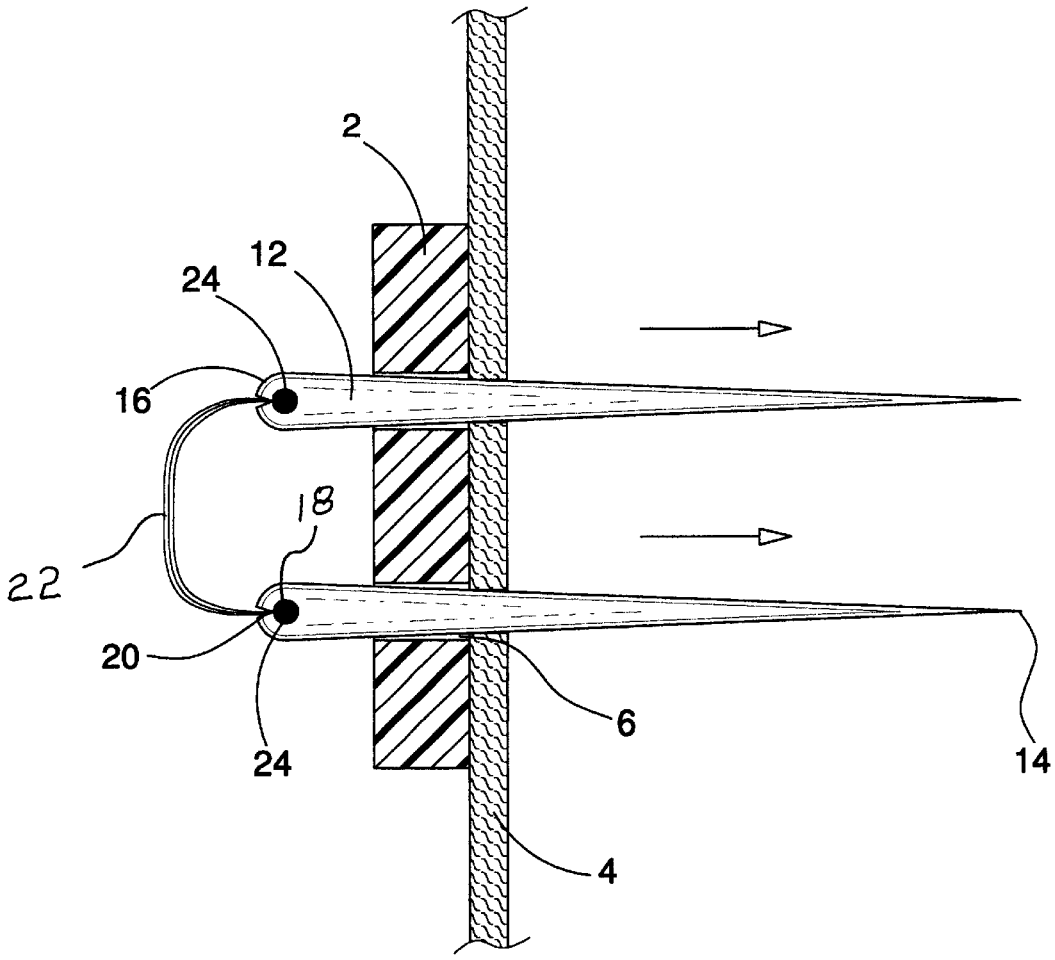
FIG. 2 is a cross-sectional view taken along the line 2—2 of FIG. 1 of the present invention.
Figure 3:
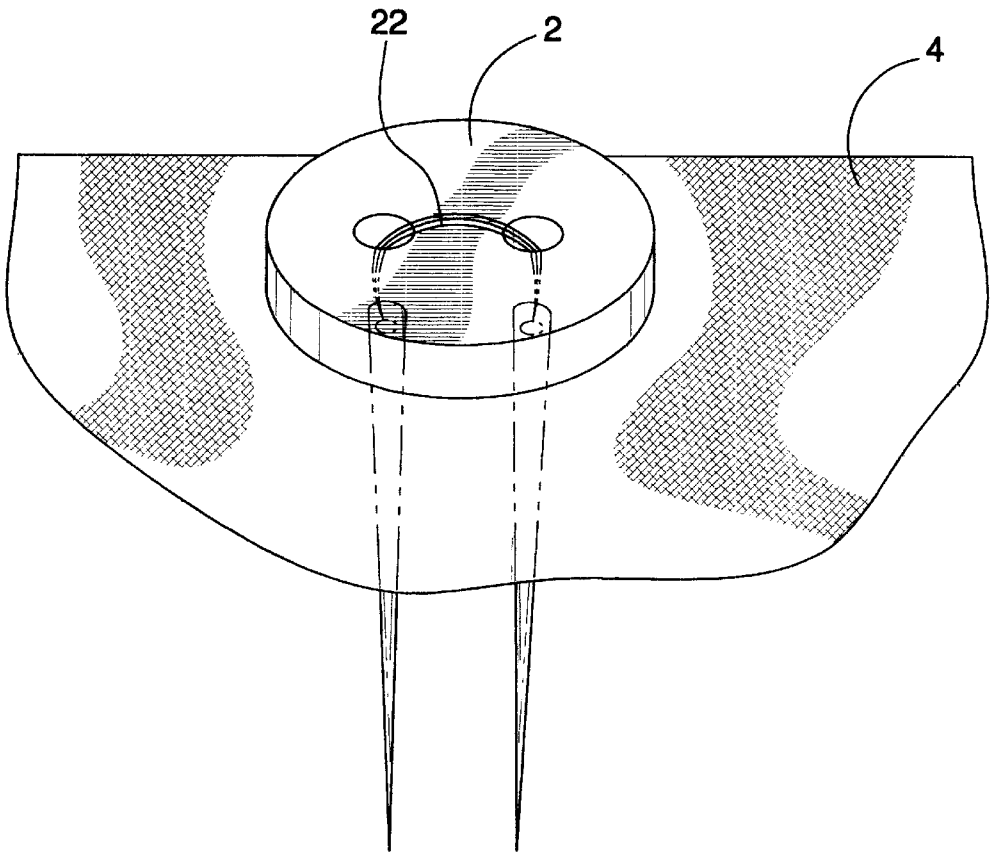
FIG. 3 is a perspective view of the present invention.
Figure 4:
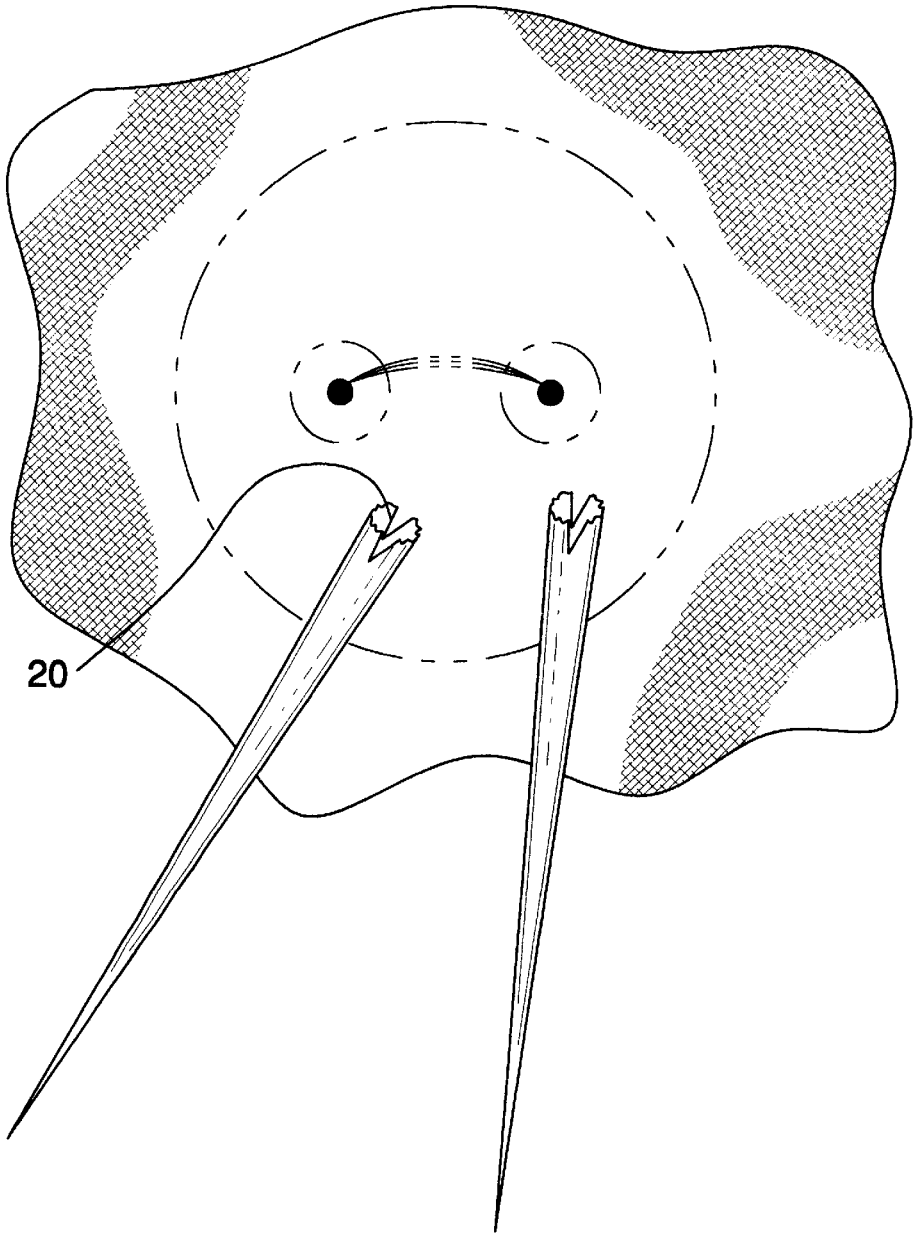
FIG. 4 is a front view of the present invention.

With reference now to the drawings, and in particular to FIGS. 1 through 4 thereof, a new button fastening apparatuses embodying the principles and concepts of the present invention and generally designated by the reference numeral 10 will be described.

As best illustrated in FIGS. 1 through 4, the present invention generally comprises a button attaching device 10 for attaching a button 2 to an article of cloth 4. The button 2 has at least two openings 6 extending therethrough. The device 10 includes a pair of elongate members 12 each having a first end 14 and a second end 16. Each of the first ends 14 is pointed. Each of the elongate members 12 has a hole 18 extending therethrough and positioned adjacent to the second ends 16. The elongate members 12 each have a slit 20 therein extending from an outer surface of the second end 16 to a corresponding one of the holes 18. Each of the elongate members 12 comprises a flexible material. The flexible material is preferably is a plastic material, though other materials such as substantially rigid elastomers may also be used, as wells as sufficiently malleable metals.

A thread 22 extends between the elongate members 12 and also extends through the holes 18. The thread 22 has a pair of knots 24 therein disposed generally adjacent to opposite ends of the thread 22 such that the elongate members 12 are secured together by the thread 22. Ideally, the knots 24 are each positioned in one of the holes 18 so that they are easily brought through the cloth 4. The thread 22 ideally includes a plurality of threads, and more preferably at least two threads. The thread 22 preferably has a length between ¼ inch and ½ inch.

In use, each of the elongate members 12 may be extended through one of the openings 6 in the button 4 and through the cloth 4 such that the button 4 is secured to the cloth 4. The elongate thread 22 can be pulled from the elongate members due to the slits 22 so that the knots 24 and thread 22 remain behind to secure the button 2 to the cloth 4. Because the thread 22 is already attached to the elongate members 12, the user does not have to thread them and thus the often-difficult step of threading a needle is bypassed. Additionally, because the knots 24 are passed through the cloth, the user need not tie the button 2 down.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A button attaching device for attaching a button to an article of cloth, the button having at least two openings extending therethrough, said device comprising:

a pair of elongate members each having a first end and a second end, each of said first ends being pointed, each of said elongate members having a hole extending therethrough and positioned adjacent to said second ends, each of said elongate members having a slit therein extending from an outer surface to a corresponding one of said holes;

a thread extending between said elongate members and extending through said holes, said thread having a pair of knots therein disposed generally adjacent to opposite ends of said thread such that said elongate members are secured together by said thread, each of said knots being positioned in one of said holes; and wherein each of said elongate members may be extended through one of the openings in the button and through the cloth such that the button is secured to the cloth, wherein said threads are selectively released through said slit and from said elongate members.

2. The button attaching device as in claim 1, wherein each of said elongate members comprises a flexible material.

3. The button attaching device as in claim 2, wherein each of said elongate members comprises a plastic material.

4. The button attaching device as in claim 1, wherein said thread comprises a plurality of threads.

5. The button attaching device as in claim 1, wherein said thread generally has a length between ¼ inch and ½ inch.

6. A button attaching device for attaching a button to an article of cloth, the button having at least two openings extending therethrough, said device comprising:

a pair of elongate members each having a first end and a second end, each of said first ends being pointed, each of said elongate members having a hole extending therethrough and positioned adjacent to said second ends, each of said second ends having a slit therein extending from an outer surface to a corresponding one of said holes, each of said elongate members comprising a flexible material, each of said elongate members comprising a plastic material;

a thread extending between said elongate members and extending through said holes, said thread having a pair of knots therein disposed generally adjacent to opposite ends of said thread such that said elongate members are secured together by said thread, each of said knots being positioned in one of said holes, said thread comprising a plurality of threads, said thread generally having a length between ¼ inch and ½ inch; and wherein each of said elongate members may be extended through one of the openings in the button and through the cloth such that the button is secured to the cloth, wherein said threads are selectively released through said slit and from said elongate members.

* * * * *